US007032360B2

(12) United States Patent
Rutten et al.

(10) Patent No.: US 7,032,360 B2
(45) Date of Patent: Apr. 25, 2006

(54) APPARATUS AND METHODS FOR PRODUCING SHRINK WRAP PACKAGING

(75) Inventors: Gerald Matthew Rutten, Alexandria, MN (US); Jonathon Kyle Hoyme, Carlos, MN (US)

(73) Assignee: Douglas Machine, Inc., Alexandria, MN (US)

( * ) Notice: Subject to any disclaimer, the term of this patent is extended or adjusted under 35 U.S.C. 154(b) by 75 days.

(21) Appl. No.: 10/696,713

(22) Filed: Oct. 29, 2003

(65) Prior Publication Data

US 2005/0092805 A1 May 5, 2005

(51) Int. Cl.
*B65B 13/02* (2006.01)

(52) U.S. Cl. ..... 53/399; 53/412; 53/442

(58) Field of Classification Search ..... 53/399, 53/389.2, 389.3, 389.4, 557, 133.8, 412, 53/442, 465

See application file for complete search history.

(56) References Cited

U.S. PATENT DOCUMENTS

| | | | | |
|---|---|---|---|---|
| 3,212,381 | A | 10/1965 | Heyer | |
| 3,283,470 | A | 11/1966 | Oelze et al. | |
| 3,353,326 | A | 11/1967 | Becker | 53/442 X |
| 3,425,544 | A | 2/1969 | Ayer et al. | |
| 3,442,436 | A | 5/1969 | Kirby, Jr. | |
| 3,503,175 | A | 3/1970 | Marasso et al. | 53/412 |
| 3,675,767 | A | 7/1972 | Taylor | 53/442 X |
| RE27,977 | E | 4/1974 | Monaghan | 53/465 X |
| 3,824,887 | A | 7/1974 | Marchard | |
| 3,855,892 | A | 12/1974 | Dilello et al. | |
| 3,892,057 | A | 7/1975 | Goode | 53/442 X |
| 3,967,433 | A | 7/1976 | Bonfiglioli | |
| 3,967,767 | A | 7/1976 | Seragnoli | 53/389.3 X |
| 4,027,390 | A | 6/1977 | Kendzior | |
| 4,077,516 | A | 3/1978 | Duerr | |
| 4,223,511 | A | 9/1980 | Black | |
| 4,351,210 | A | 9/1982 | McKindary | |
| H9 | H | 1/1986 | Ashmore | |
| 4,583,348 | A | 4/1986 | Treiber et al. | |
| 4,586,312 | A | 5/1986 | Limousin | 53/442 X |
| 4,620,467 | A | 11/1986 | Margraf et al. | |

(Continued)

FOREIGN PATENT DOCUMENTS

| | | |
|---|---|---|
| CA | 0987580 | 4/1976 |

(Continued)

*Primary Examiner*—Sameh H. Tawfik
(74) *Attorney, Agent, or Firm*—Alan D. Kamrath; Nikolai & Mersereau, P.A.

(57) ABSTRACT

An apparatus (10) is disclosed including a web of film (20) extending between first and second pairs of pinch rollers (12–15) and onto a vacuum table (18). A rotary cutter (46) positioned before the first pair of pinch rollers (12, 13) includes laterally extending and spaced knives (52) for creating cuts (54, 58) in the film (20) which expand into vent openings (54') positioned over the sides (68) of the product (72) when the film (20) is wrapped around and shrunk upon the product (72). A further rotary cutter (30) positioned between the pairs of pinch rollers (12–15) includes a cut-off knife (36) and first and second blades (44). The cut-off knife (36) creates a cut (60) in the film (20) to form a single sheet of film (20) and includes notches (38) in its cutting edge to form tie strips (62) connecting the single sheet to the web of film (20). A kicker plate (84) of a rotatable tie strip breaker (80) engages the cut film (20) on the vacuum table (18) at the trailing edge and at a speed faster than the film (20) is being conveyed to place tensional force on and breaking the tie strips (62).

10 Claims, 2 Drawing Sheets

U.S. PATENT DOCUMENTS

| | | | | |
|---|---|---|---|---|
| 4,642,970 | A | 2/1987 | Bane | 53/442 X |
| 4,650,453 | A | 3/1987 | Blidung et al. | |
| 4,913,767 | A | 4/1990 | Longworth | |
| 4,920,652 | A | 5/1990 | Johnson | |
| 4,956,963 | A | 9/1990 | Johnson | |
| 5,046,258 | A | 9/1991 | Cahill et al. | |
| 5,067,612 | A | 11/1991 | Tsuchiya et al. | |
| 5,092,103 | A | 3/1992 | Focke et al. | |
| 5,171,593 | A | 12/1992 | Doyle | |
| 5,201,463 | A | 4/1993 | George | |
| 5,375,718 | A | 12/1994 | Honma et al. | |
| 5,461,954 | A | 10/1995 | Boriani et al. | 53/389.3 X |
| 5,511,664 | A | 4/1996 | Aramaki et al. | |
| 5,619,843 | A | 4/1997 | Ganz | 5/557 X |
| 5,771,662 | A | 6/1998 | Struges et al. | 54/399 |

FOREIGN PATENT DOCUMENTS

| | | | |
|---|---|---|---|
| EP | 0590217 | 4/1994 | |
| GB | 1 397 709 | 6/1975 | |
| GB | 2227473 | 8/1990 | 53/442 |

46
50
52
52
30
34
36
38
38
40
42
44
18
20
20
54
54'
54'
56
56
58
58
58
58
60
60
60
60
62
62
62
62
68
72
74
78

APPARATUS AND METHODS FOR PRODUCING SHRINK WRAP PACKAGING

BACKGROUND

The present invention generally relates to shrink wrap packaging and apparatus and methods for producing the same and particularly to shrink wrap packaging and apparatus and methods for feeding, perforating and cutting a shrink wrap film utilized in producing the shrink wrap packaging.

In shrink wrapping, a single sheet of shrink wrap film is wrapped around the product and into a tubular form. The overlapping lateral edges are located beneath the product and are sealed or otherwise joined together. During shrinking in a heat tunnel, the longitudinal edges of the shrink wrap film collapse against the ends of the product creating bulls eye-type openings.

Various deficiencies exist in prior shrink wrap packaging and the methods of its fabrication. One such deficiency is that the single sheet of shrink wrap film was typically cut from a supply roll of the film. A common manner to cut the sheet from the web of film was to engage the film with a hot iron to melt the film and thus sever the sheet from the film. This hot iron is a high wear component and is always a source of operational problems. Another approach is to utilize a rotary cutter which cuts the film. However, this approach experienced problems that the new leading edge of the web of film did not continue to follow the desired path of the film as a result of the velocity of the film and air resistance, the memory of the film, and/or the snap back of the film when the tension was released on the film because of cutting. These problems were overcome by cutting the film while the film is held across the cut and/or by including mechanical devices which grasp and pull the new leading edge, but such approaches unduly complicated the construction of the apparatus.

U.S. Pat. No. 5,771,662 represents a major advance in the field of feeding, perforating and cutting a shrink wrap film. Specifically, methods and apparatus are disclosed in U.S. Pat. No. 5,771,662 for forming a single sheet of film from a web of film and connected to the web of film by tie strips to maintain tension on the web of film after cutting, with the tie strips later being broken to separate the single sheet of film from the web of film.

However, problems have been encountered with narrow or stretchy film. If the web of film is too tight when the knife cuts the film, it tends to snap apart. This "whip back" causes the lead edge of the next sheet to have folded corners or a lack of tension for the next cut. If the web of film is too loose, the film will not be completely cut and a jam will result. A folded corner can also cause a jam as the film will not be delivered through the opening to the product.

SUMMARY

The present invention solves these problems and other needs in the field of shrink wrapping by providing, in the preferred form, the breaking of tie strips connecting a single sheet of film and the new leading edge of a continuous web of film by pushing on the single sheet of film being conveyed on a vacuum table, adjacent to the trailing edge, and faster than the web of film is being conveyed on the vacuum table to place tensional forces on the tie strips exceeding their tensional strength.

It is thus an object of the present invention to provide novel shrink wrap packaging and apparatus and methods for producing the same.

It is further an object of the present invention to provide such novel methods and apparatus maintaining tension on the web of film when a sheet is cut therefrom.

It is further an object of the present invention to provide such novel methods and apparatus insuring that the web of film follows the desired path when a sheet is cut therefrom.

It is further an object of the present invention to provide such novel methods and apparatus preventing snap back and curling of the web of film when a sheet is cut therefrom.

It is further an object of the present invention to provide such novel methods and apparatus not requiring devices which hold the film across the cut or which grasp the leading edge of the web of film.

It is further an object of the present invention to provide such novel methods and apparatus overcoming problems encountered with narrow and/or stretchy film.

These and further objects and advantages of the present invention will become clearer in light of the following detailed description of an illustrative embodiment of this invention described in connection with the drawings

DESCRIPTION OF THE DRAWINGS

The illustrative embodiment may best be described by reference to the accompanying drawings where.

Figure 1:
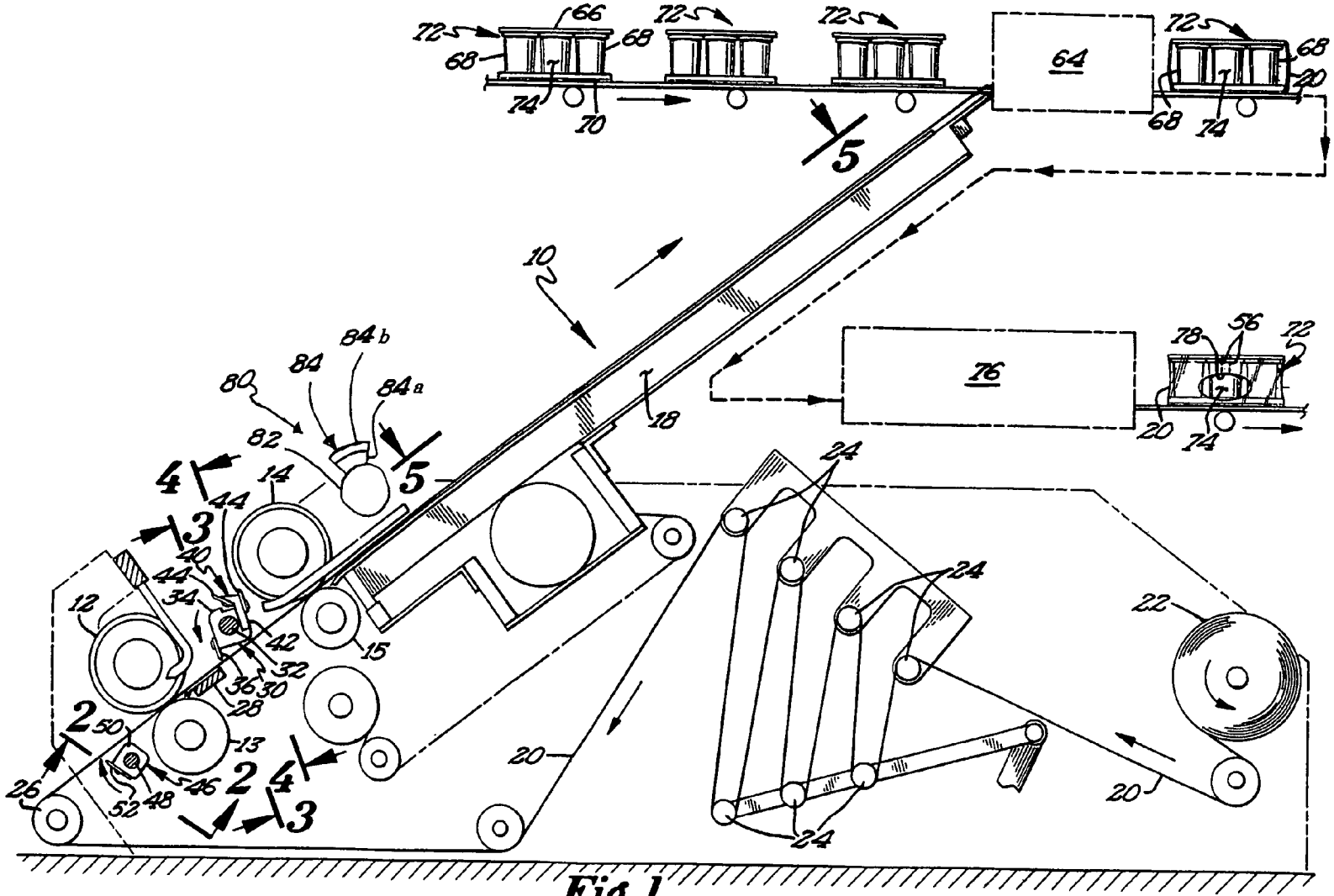
FIG. 1 shows a diagrammatic side view of an apparatus for producing shrink wrap packaging according to methods of the preferred teachings of the present invention.
Figures 2, 3, 4, 5, 6:
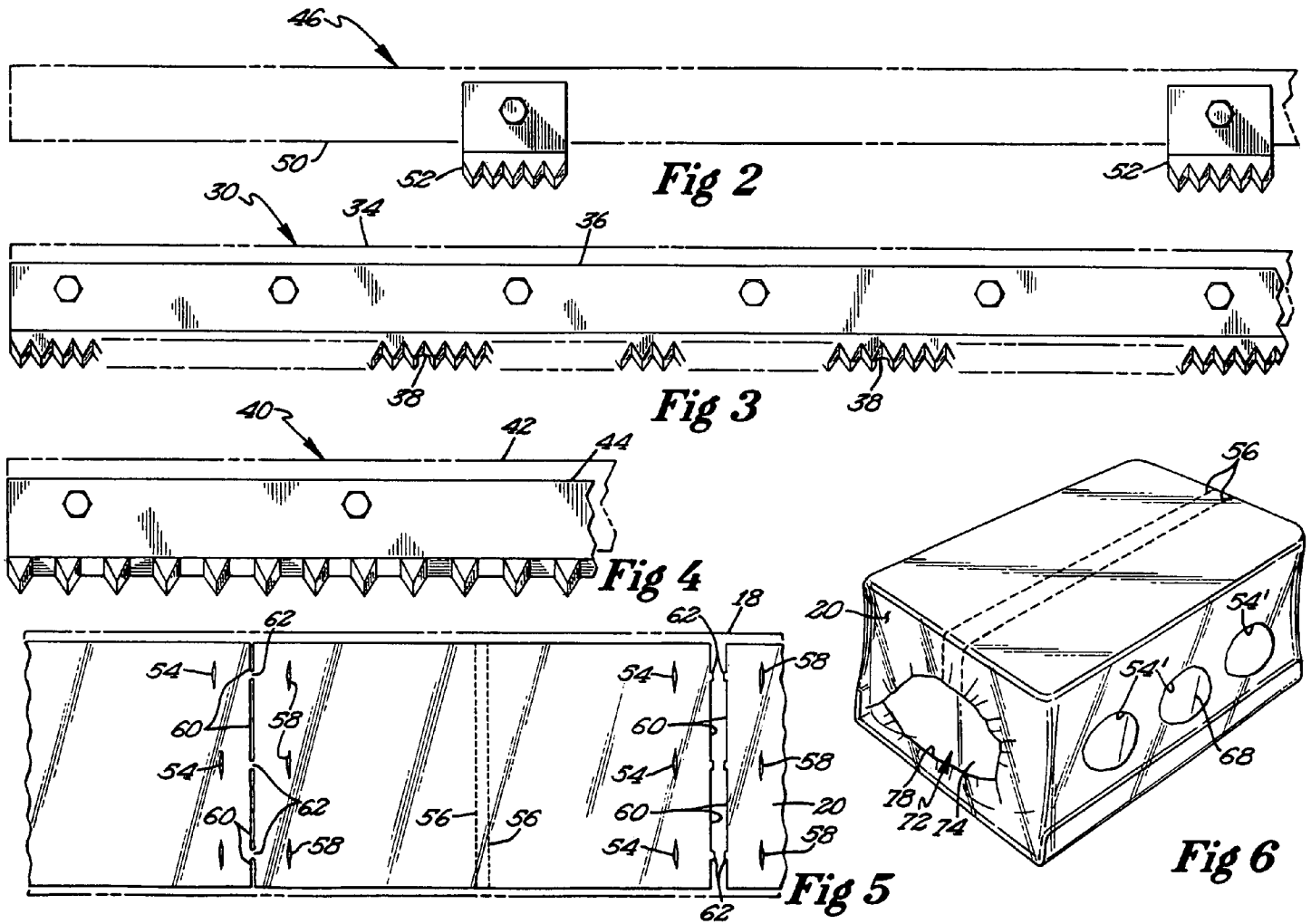
FIG. 2 shows a partial, cross-sectional view of the apparatus of FIG. 1 according to section line 2—2 of FIG. 1.
FIG. 3 shows a partial, cross-sectional view of the apparatus of FIG. 1 according to section line 3—3 of FIG. 1.
FIG. 4 shows a partial, cross-sectional view of the apparatus of FIG. 1 according to section line 4—4 of FIG. 1.
FIG. 5 shows a partial, cross-sectional view of the apparatus of FIG. 1 according to section line 5—5 of FIG. 1.
FIG. 6 shows a perspective view of the shrink wrap packaging produced by the apparatus of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "width", "length", "end", "side", "horizontal", "vertical", "axial", "radial", "longitudinal", "lateral", and similar terms are used herein, it should be understood that these terms have reference only to the structure shown in the drawings as it would appear to a person viewing the drawings and are utilized only to facilitate describing the illustrative embodiment.

DESCRIPTION

Apparatus for feeding, perforating and cutting a shrink wrap film according to the preferred teachings of the present invention is shown in the drawings and generally designated 10. Generally, apparatus 10 includes first and second pairs of pinch rollers 12–15 having parallel spaced axes. In particular, the outer peripheries of rollers 12 and 13 abut and the outer peripheries of rollers 14 and 15 abut. A plane extending tangentially from where the peripheries of rollers 12 and 13 abut is also tangent to the peripheries of rollers 14 and 15 at their abutment. Apparatus 10 further includes a vacuum table 18 including a top conveying surface extending from adjacent to the nip of rollers 14 and 15 on the opposite side from rollers 12 and 13. The top conveying surface lies in the same plane as the plane tangent to the abutments of rollers 12 and 13 and rollers 14 and 15. In the most preferred form, the plane of the top conveying surface of vacuum table 18 and the plane tangent to the abutments of rollers 12 and 13 and rollers 14 and 15 extends at an acute angle to the horizontal in the order of 40°, with the height of vacuum table 18 increasing with increasing spacing from rollers 14 and 15. The speed of the top conveying surface of vacuum table 18 in the most preferred form is equal to the linear speed of the peripheries of rollers 14 and 15 at their abutment.

Film 20 is delivered from a film roll 22 through a plurality of dance bars 24 which create film tension. From dance bars 24, film 20 extends to an idler roller 26. Film 20 extends tangentially from the periphery of idler vacuum table 18 and the plane tangent to the abutments of rollers 12 and 13 and rollers 14 and 15. From idler roller 26, film 20 extends through the abutment nip of rollers 12 and 13 and then through the abutment nip of rollers 14 and 15 and onto the top conveying surface of vacuum table 18. Thus, film 20 from roller 26 to and including vacuum table 18 lies in a single plane. After the abutment nip of rollers 12 and 13 and prior to rollers 14 and 15, film 20 passes over a deck 28 having a top surface lying in the same plane as the plane of the top conveying surface of vacuum table 18 and the plane tangent to the abutments of rollers 12 and 13 and rollers 14 and 15.

A first rotary cutter 30 is positioned between the pairs of pinch rollers 12–15. In particular, cutter 30 includes a shaft 32 rotatable about an axis parallel to and spaced from the axes of rollers 12–15. A knife mounting block 34 is rotatably fixed to shaft 32 such as being slideably mounted thereon but in the most preferred form is integrally formed therewith, with block 34 having square cross sections in the most preferred form. Shaft 32 is mounted such that mounting block 34 is positioned adjacent but in a nonabutting relation to film 20 extending between the pairs of pinch rollers 12–15 in all rotatable positions of cutter 30. Cutter 30 further includes a cut-off knife 36 mounted to one side of mounting block 34 and having a laterally extending cutting edge of a size at least equal to and preferably larger than the spacing between the longitudinal edges of the web of film 20. The cutting edge of knife 36 extends radially beyond mounting block 34 a distance greater than the radial spacing of film 20 from the axis of shaft 32 and cutter 30. In the most preferred form, the cutting edge of knife 36 is serrated with triangular-shaped, equal-size teeth, with knife 36 being sharpened on all cutting surfaces and in particular the valley, tooth and the surface of the tooth in the most preferred form. The teeth of knife 36 have centers spaced 0.118 inches (2.998 mm) and a valley depth from the cutting edge of 0.1429 inch (3.630 mm) with a valley relief depth from the cutting edge of 0.2699 inch (6.855 mm) in the most preferred form. Knife 36 further includes a plurality of laterally spaced notches 38 formed in the cutting edge which in the preferred form are centered in the valley between two teeth. Notches 38 have a depth into the cutting edge of knife 36 sufficient to prevent cutting of film 20 when the cutting edge of knife 36 engages film 20. Notches 38 have a relatively narrow width which in the preferred form is slightly greater than the spacing between the centers of the teeth of the cutting edge and in the most preferred form is 0.120 inches (3.048 mm).

In the preferred form, cutter 30 further includes provisions 40 for cutting parallel, spaced perforations 56 extending laterally across film 20 and from and between the longitudinal edges of film 20. Generally, provisions 40 include an elongated knife holder 42 secured to block 34 on the diametric opposite side from knife 36. First and second perf blades or knives 44 are in turn secured to holder 42, with one of the knives 44 being parallel to but spaced from knife 42 but with their cutting edges extending in opposite tangential directions. The other of knives 44 extends at an acute angle in the order of 400 from the first knife 44 in the direction of rotation of cutter 30. In the most preferred form, knives 44 each include a plurality of cutting edges which are spaced laterally from each other, with the cutting edges having equal lateral lengths and the spacing between the cutting edges having equal lateral lengths which are equal to the lateral lengths of the cutting edges in the most preferred form. In the most preferred form, the cutting edges of knives 44 each is in the form of a single V-shaped tooth.

In the preferred form, apparatus 10 includes a second rotary cutter 46 which is positioned longitudinally in front of the first pair of pinch rollers 12 and 13. In particular, cutter 46 includes a shaft 48 rotatable about an axis parallel to and spaced from the axes of rollers 12–15. A knife mounting block 50 is rotatably fixed to shaft 48 such as being slideably mounted thereon but in the most preferred form is integrally formed therewith, with block 50 having square cross sections in the most preferred form. Cutter 46 further includes a plurality of laterally spaced vent blades or knives 52 mounted to one side of mounting block 50 and each having a cutting edge extending radially beyond mounting block 50 greater than the radial spacing of film 20 from the axis of shaft 48 and cutter 46. The lateral width of each knife 52 is relatively small in comparison to the lateral width of film 20 and the combined lateral widths of knives 52 are considerably less than the lateral width of film 20. In the most preferred form, the cutting edges of knives 52 are serrated with triangular-shaped, equal-size teeth.

Now that the basic construction of apparatus 10 according to the preferred teachings of the present invention has been explained, the operation and some of the advantages of apparatus 10 as well as its utilization in the production of shrink wrap packaging for a product can be explained and appreciated. Specifically, a web of film 20 moves from roll 22 through dance bars 24 and around idler roller 26 to the nip between rollers 12 and 13. Rotary cutter 46 is in a rotational position with knives 52 not engaging film 20. From rollers 12 and 13, film 20 extends over deck 28 to the nip between rollers 14 and 15. Film 20 is under tension in the portion of its path between pinch rollers 12–15. Rotary cutter 30 is in a rotational position with knives 36 and 44 not engaging film 20 and for purposes of explanation it will be assumed that knives 44 are in a rotational position between film 20 and knife 36. From rollers 14 and 15, film 20 moves on the top conveying surface of vacuum table 18. It should be appreciated that the operation of apparatus 10 is continuous. For purposes of explanation, it will be assumed that rotary cutter 30 has just finished rotating and knife 36 has substantially cut film 20 to define a trailing edge upstream of cut 60 and a leading edge downstream of cut 60. Based upon the foregoing, the formation of the next single sheet of film 20 from the web of film 20 according to the teachings of the present invention will be explained. Specifically, the web of film 20 is moved along the path of apparatus 10 until knives 52 are positioned at the first desired longitudinal position from the leading edge of film 20. At that time, rotary cutter 46 is rotated to engage the cutting edges of knives 52 with the web of film 20 to partially cut the web of film 20 and to create a plurality of laterally extending cuts 54 in the web of film 20 located between the first and second longitudinal edges and leaving unsevered portions of the web of film 20 laterally between cuts 54. After the creation of cuts 54, rotary cutter 46 is rotated to a rotational position with knives 52 not engaging film 20. Further, the web of film 20 is moved along the path of apparatus 10 until knives 44 are positioned at the desired longitudinal position from the leading edge of film 20. At that time, rotary cutter 30 is rotated to generally simultaneously engage the cutting edges of knives 44 with the web of film 20 to partially cut the web of film 20 and to create a plurality of first and second laterally spaced cuts or perforations 56 in the web of film 20 extending between the first and second longitudinal edges and leaving unsevered portions of the web of film 20 laterally between cuts 56. After the creation of perforations 56, rotary cutter 30 is rotated to a rotational position with knives 36 and 44 not engaging film 20 and with knife 36 in a rotational position between knives 44 and film 20. Further, the web of film 20 is moved along the path of apparatus 10 until knives 52 are positioned at the second desired longitudinal position from the leading edge of film 20. At that time, rotary cutter 46 is rotated to engage the cutting edges of knives 52 with the web of film 20 to partially cut the web of film 20 and to create a plurality of laterally extending cuts 58 in the web of film 20 located between the first and second longitudinal edges and leaving unsevered portions of the web of film 20 laterally between cuts 58. After the creation of cuts 58, rotary cutter 46 is rotated to a rotational position with knives 52 not engaging film 20. Further, the web of film 20 is moved along the path of apparatus 10 until knife 36 is positioned at the desired longitudinal position from the leading edge of film 20. At that time, rotary cutter 30 is rotated to engage the cutting edge of knife 36 with the web of film 20 to create a cut 60 in the web of film 20 and extending substantially between the first and second longitudinal edges, with the cutting edge of knife 36 not severing the web of film 20 in notches 38. After the creation of cut 60, rotary cutter 30 is rotated to a rotational position with knives 36 and 44 not engaging film 20 and with knives 44 in a rotational position between film 20 and knife 36. The operation is then continued for the next sheet of film 20 in the same manner.

In the most preferred form, cuts 54, 56, 58 and 60 are formed by planar cutting edges having minimal thicknesses. Thus, the creation of cuts 54, 56, 58 and 60 in the preferred form does not involve the removal of portions of film 20 such as would be the case if the cutting edges were annular in shape, were not planar, and/or did not have minimal thickness.

It should be realized that although cuts 54, 56, 58 and 60 are formed in each sheet of film 20 in the most preferred form, the actual sequence of cutting can vary depending upon various factors including the particular size of the single sheet of film 20 desired and/or the desired longitudinal positions of cuts 54, 56 and 58 intermediate the leading and trailing edges of the single sheet of film 20. As an example, cuts 54 could be created in film 20 prior to the creation of cut 60 of the upstream single sheet of film 20, cuts 58 could be created in film 20 prior to the creation of perforations 56, and the like.

In the most preferred form, film 20 continues to move through pinch rollers 12–15 during the rotation of rotary cutters 30 and 46 which accurately create cuts 54, 56, 58 and 60. However, it should be appreciated that cuts 54, 56, 58, and 60 could be created by other types of cutters and/or in alternate modes of operation.

Cut 60 defines the trailing edge of the single sheet of film 20 which is upstream of cut 60 and a new leading edge for the web of film 20 which is downstream of cut 60. However, cut 60 includes unsevered portions or tie strips 62 corresponding to notches 38 formed in knife 36. It should be realized that the single sheet of film 20 remains attached to the web of film 20 by tie strips 62, with the single sheet of film 20 thereby pulling the leading edge of the web of film 20 toward and through rollers 14 and 15. Further, tension of film 20 between pinch rollers 12 and 13 and pinch rollers 14 and 15 is not completely lost when the single sheet of film 20 is formed from the web of film 20 by the creation of cut 60. Thus, the possibility of the new leading edge of the web of film 20 not following the desired path to pinch rollers 14 and 15 is virtually eliminated. Specifically, the web of film 20 is not allowed to snap back because of release of tension on film 20 as was previously allowed since tension on film 20 is maintained. Similarly, the new leading edge of the web of film 20 will not curl because of the memory of film 20 being previously rolled on roll 22 due to the interconnection of the upstream single sheet of film 20. Similarly, when cut 60 just leaves the nip of pinch rollers 14 and 15, tie strips 62 insure that the leading edge of the downstream film 20 lies flushly upon the top conveying surface of vacuum table 18 and is securely held by vacuum table 18 to prevent film 20 from curling such as the result of memory or due to the velocity of film and air resistance. Thus, problems of film 20 not continuing to follow the desired path through apparatus are not encountered, and devices holding the film across the cut, which grasp the cut, and the like are not required. Further, apparatus 10 does not rely upon gravity to advance film 20 and can be operated at any desired orientation and at any desired position relative to wrapping apparatus 64 including below wrapping apparatus 64. Another major advantage is that the distance between rollers 12 and 13 and rollers 14 and 15 can be minimized to reduce the longitudinal length of apparatus 10 while still achieving enough tension on film 20 to create the next cut by rotary cutter 30 and while making cleaner cuts on longitudinally shorter lengths of film 20.

It should be realized that film 20 will be tensioned between pinch rollers 12 and 13 and pinch rollers 14 and 15. This tensional force can not exceed the tensional strength of film 20 and specifically so as to cause undesired stretching, tearing, or similar damage to film 20. It should be appreciated that in the most preferred form where film 20 includes cuts 54, 56 and 58, this tensional force can not exceed the tensional strength of the unsevered portions of film 20 laterally between cuts 54, 56 and 58.

As the leading edge of film 20 passes between the nip of pinch rollers 14 and 15, film 20 moves into the next portion of the path of apparatus 10 which in the preferred form is onto vacuum table 18, with the portion of the path defined by vacuum table 18 being contiguous to the portion of the path defined between rollers 12–15. It should be appreciated that the portions of film 20 downstream remain in the portion of the path downstream from pinch rollers 14 and 15. Vacuum table 18 moves film 20 at its speed with the vacuum force holding film 20 against the top conveying surface. According to the teachings of the present invention, apparatus 10 includes a tie strip breaker 80. Specifically, in the preferred form shown, tie strip breaker 80 includes a cylindrical roller 82 and, for each sheet of film 20 being fed, a kicker plate 84. In the most preferred form, each kicker plate 84 includes an inner portion 84*a* formed of a rigid material such as metal and having an inner surface abutting with the outer surface of roller 82 and an outer surface concentric to the outer surface of roller 82 and an outer portion 84*b* formed of rubber or similar material and having an inner surface abutting with the outer surface of the inner portion 84*a* and an outer surface concentric to the outer surfaces of roller 82 and of inner portion 84*a*. The outer portion 84*a* can be formed as a single piece or as multiple pieces. Kicker plate 84 has an axial width at least equal to the width of film 20 and has a circumferential length less than that of roller 82 and in the most preferred form in the range of 60°. Tie strip breaker 80 is intermittently driven such as by a stepper motor in the most preferred form. Specifically, tie strip breaker 80 is rotatable between a disengaged position and an engaged position. In the engaged position, the outer surface of outer portion 84*b* of kicker plate 84 engages with and sandwiches film 20 against vacuum table 18. In the disengaged position, tie strip breaker 80 does not interfere with film 20 being conveyed on vacuum table 18, and in the most preferred form, tie strip breaker 80 and kicker plate 84 do not engage film 20 being conveyed on vacuum table.

Once cut 60 passes between the abutment of pinch rollers 14 and 15 and onto vacuum table 18 and is generally aligned with tie strip breaker 80, tie strip breaker 80 is rotated to engage outer portion 84*b* with film 20 generally upstream of cut 60. The peripheral speed of outer portion 84*a* is greater than film 20 and vacuum table 18 such that when film 20 is engaged upstream of cut 60, tie strip breaker 80 pushes the trailing edge and a portion of film 20 upstream thereof at a speed faster than vacuum table 18. As the leading edge and the portion of film 20 downstream thereof are held by pinch rollers 14 and 15 from moving faster than vacuum table, tensional force is placed upon tie strips 62 due to the differing speeds upstream and downstream of cut 60. This tensional force should exceed the tensional strength of tie strips 62 causing tie strips 62 to stretch and break and, generally without deformation of the trailing edge and leading edge between tie strips 62. However, due to being pushed at a greater speed than vacuum table 18, the trailing edge and a portion of film 20 upstream thereof will be rolled up on vacuum table 18 creating a longitudinal spacing from film 20 still held by pinch rollers 12–15 and will move with and at the same speed as the top conveying surface of vacuum table 18.

The single sheet of film 20 will move on vacuum table 18 to wrapping apparatus 64 of any desired construction. In wrapping apparatus 64, the single sheet of film 20 is wrapped around the top 66, first and second sides 68, and bottom 70 of the product 72 desired to be packaged. The longitudinal edges of film 20 extend beyond the first and second ends 74 of product 72. It should be understood that product 72 could be a single component or multiple components such as a plurality of individual containers supported upon a tray as shown in the drawings. It should further be noted that the leading edge of the single sheet of film 20 overlaps the trailing edge of the single sheet of film 20 and is positioned over bottom 70 of product 72 or in other words the overlapping lateral edges are sandwiched between bottom 70 and the support surface for the wrapped product 72.

After apparatus 64, the wrapped product 72 is suitably heated such as in a heat tunnel 76 where the overlapping lateral edges are sealed together and film 20 is shrunk around product 72 in a conventional manner. It should be realized that during shrinking, the portions of film 20 extending beyond top 66, sides 68, and bottom 70 collapse against ends 74 of product 72, with the longitudinal edges of film 20 creating bulls eye openings 78 intermediate top 66, bottom 70, and sides 68 and closely adjacent ends 74 of product 72. It should be realized that sealing the lateral edges of film 20 together and shrinking film 20 upon product 72 can be performed in any desired manner to form the shrink wrap packaging according to the teachings of the present invention.

In the most preferred form, the shrink wrap packaging according to the teachings of the present invention includes perforations 56 extending from bulls eye opening 78 on the first end 74 of product 72 to bulls eye opening 78 on the second end 74 of product 72 and positioned over top 66 of product 72. It should be appreciated that rotary cutter 30 should be rotated to cut film 20 so that perforations 56 are located intermediate sides 68 and in particular between the uppermost portions of openings 78. To remove the shrink wrapping when desired, it is only necessary to grab a longitudinal edge of film 20 at one of the openings 78 and pull to tear a strip of film 20 located between perforations 56 to the other opening 78. It is not necessary to raise the shrink wrap packaging from the support surface or invert the shrink wrap packaging to obtain access or completely tear the strip of film. Thus, the remaining portion of the shrink wrapping is then an elongated strip having first and second free lateral edges defined by first and second perforations 56, respectively. Because perforations 56 extend laterally and across the wrap direction of film 20 around product 72, the free edges of the torn shrink wrapping can be raised from top 66 of product 72 and moved outwardly to allow ease of removal of product 72 therefrom and specifically without formation of cup-shaped receptacles such as would be formed by having longitudinal perforations in the shrink wrapping. Thus, the shrink wrap packaging according to the teachings of the present invention allows product 72 to be easily removed from the shrink wrapping and overcomes the deficiencies of current approaches.

Further, in the most preferred form, the shrink wrap packaging according to the teachings of the present invention includes vent openings 54' in the shrink wrapping and positioned in a single row over each of sides 68 of product 72. In particular, as a result of and during the wrapping of film 20 around product 72 and shrinking film 20 on product 72, lateral cuts 54 and 58 expand into openings 54' which are generally oval shaped. Openings 54' are of a large size to readily allow air flow there through and specifically are substantially larger than pin holes and are of a substantial size in comparison to the height and width of product 72. It was found that providing longitudinal cuts in film 20 generally at the same location as cuts 54 and 58 did not create openings 54' of the desired size. Further, in the preferred form where product 72 is in the form of multiple components in an array of columns and rows and spaced from each other, openings 54' are provided in the shrink wrapping to be aligned with the spacing between the individual components of product 72, Thus, openings 54' are not blocked by the side(s) of any individual component(s) and unrestricted air passage is allowed there through. Openings 54' and openings 78 allow free circulation of air between the individual components of product 72. Such circulation of air is very important if product 72 is packaged warm and allowed to cool after film 20 is shrink wrapped. An example of such a product 72 where this would be desirable would be individual containers of yogurt. It should be appreciated that knives 52 should be positioned at the lateral spacing along rotary cutter 46 and rotary cutter 46 should be rotated to cut film 20 such that cuts 54 and 58 are located in film 20 with openings 54' positioned over sides 68 of product 72 and at the desired location relative to the particular product 72 being packaged and in the most preferred form with the portions of sheet 20 extending over top 66 and bottom 70 of product 72 being free of cuts 54 and 58 and openings 54'. Thus, the shrink wrap packaging according to the teachings of the present invention includes vent openings 54' in the shrink wrapping to allow air circulation for cooling, with cuts 54 and 58 which are expanded into vent opening 54' created during the formation of the single sheet of film 20 from the web of film 20 and without requiring extra steps in the production of the shrink wrap packaging.

It should be realized that deck 28 provides support to the web of film 20 during cutting by rotary cutter 30 and specifically reduces the amount of deflection of film 20. This reduces the amount of loss of tension during cutting. Although rotary cutter 46 is positioned in front of pinch rollers 12–15 and does not include structure corresponding to deck 28, the web of film 20 should be sufficiently tensioned between idler roller 26 and pinch rollers 12 and 13 as the result of dance bars 24 and the extent of cuts 54 and 58 is relatively small in comparison to the extent of cuts 56 and 60.

Providing rotary cutter 30 with provisions for creating both cuts 56 and 60 is advantageous. Specifically, only a single rotary cutter 30 and deck 28 are utilized as opposed to separate rotary cutters for knife 36 and for provisions 40. Further, the longitudinal distance between rollers 12 and 13 and rollers 14 and 15 can be minimized to thereby minimize the longitudinal extent of apparatus 10.

Although apparatus 10 and the shrink wrap packaging produced thereby includes several unique features according to the preferred teachings of the present invention and is believed to produce synergistic results, it should be realized that such features can be utilized individually or in other combinations. As an example, apparatus 10 could form single sheets of film 20 connected by tie strips 62 to the web of film 20 without the creation of cuts 54 and 58 and/or perforations 56. Likewise, cuts 54 and 58 and/or perforations 56 could be created in single sheets of film 20, with the single sheet of film 20 being formed from a web of film 20 by approaches other than with use of tie strips 62 as in the present invention.

Although tie strip breaker 80 is shown in the most preferred form as being rotatable and is believed to be advantageous, tie strip breaker 80 according to the teachings of the present invention can move between its disengaged and engaged positions and can take other forms including but not limited to reciprocal pusher plates.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Method comprising: supplying a continuous web of film having a leading edge and first and second, spaced, longitudinal edges; moving the web of film through a first portion of a path, with the web of film being under tension in the first portion of the path; substantially cutting the web of film in the first portion between the first and second longitudinal edges to form a single sheet of film having a trailing edge spaced from the leading edge and creating a new leading edge on the web of film, with the trailing edge and new leading edge being connected together by a plurality of tie strips to maintain tension of the web of film in the first portion of the path after cutting; conveying the substantially cut web of film on a vacuum table; and breaking the tie strips between the single sheet of film and the new leading edge on the vacuum table by pushing on the web of film at the trailing edge faster than the substantially cut web of film being conveyed on the vacuum table and placing tensional forces on the tie strips which exceed tensional strength of the tie strips.

2. The method of claim 1 wherein moving the web of film through the first portion comprises passing the web of film between first and second pairs of pinch rollers.

3. The method of claim 2 wherein substantially cutting the web comprises: providing a rotary cutter including a knife having a laterally extending cutting edge of a size at least equal to the spacing between the longitudinal edges of the web of film, with the cutting edge including a plurality of laterally spaced notches; and rotating the cutter to engage the cutting edge of the knife with the web of film with the cutting edge not severing the web of film in the notches and thereby forming the tie strips between the single sheet of film and the new leading edge of the web of film.

4. The method of claim 3 with pushing on the web comprising:

providing a rotatable tie strip breaker rotatable between a disengaged position and an engaged position, with the tie strip breaker in the disengaged portion not interfering with the substantially cut web of film being conveyed on the vacuum table, with the strip breaker in the engaged position engaging with the substantially cut web of film being conveyed on the vacuum table; and rotating the tie strip breaker to engage the substantially cut web of film being conveyed on the vacuum table at the trailing edge and at a speed faster than the substantially cut web of film is being conveyed on the vacuum table.

5. The method of claim 4 with providing the rotatable tie strip comprising providing a roller including a kicker plate for engaging with the substantially cut web of film being conveyed on the vacuum table.

6. The method of claim 1 wherein substantially cutting the web comprises: providing a rotary cutter including a knife having a laterally extending cutting edge of a size at least equal to the spacing between the longitudinal edges of the web of film, with the cutting edge including a plurality of laterally spaced notches; and rotating the cutter to engage the cutting edge of the knife with the web of film with the cutting edge not severing the web of film in the notches and thereby forming the tie strips between the single sheet of film and the new leading edge of the web of film.

7. The method of claim 6 with pushing on the web comprising:

providing a rotatable tie strip breaker rotatable between a disengaged position and an engaged position, with the tie strip breaker in the disengaged portion not interfering with the substantially cut web of film being conveyed on the vacuum table, with the strip breaker in the engaged position engaging with the substantially cut web of film being conveyed on the vacuum table; and rotating the tie strip breaker to engage the substantially cut web of film being conveyed on the vacuum table at the trailing edge and at a speed faster than the substantially cut web of film is being conveyed on the vacuum table.

8. The method of claim 7 with providing the rotatable tie strip comprising providing a roller including a kicker plate for engaging with the substantially cut web of film being conveyed on the vacuum table.

9. The method of claim 1 with pushing on the web comprising:

providing a rotatable tie strip breaker rotatable between a disengaged position and an engaged position, with the tie strip breaker in the disengaged portion not interfering with the substantially cut web of film being conveyed on the vacuum table, with the strip breaker in the engaged position engaging with the substantially cut web of film being conveyed on the vacuum table; and rotating the tie strip breaker to engage the substantially cut web of film being conveyed on the vacuum table at the trailing edge and at a speed faster than the substantially cut web of film is being conveyed on the vacuum table.

10. The method of claim 9 with providing the rotatable tie strip comprising providing a roller including a kicker plate for engaging with the substantially cut web of film being conveyed on the vacuum table.

* * * * *